US006539574B2

(12) United States Patent
Payne et al.

(10) Patent No.: US 6,539,574 B2
(45) Date of Patent: Apr. 1, 2003

(54) NON-ABRASIVE DEBURRING DEVICE FOR METAL PARTS

(75) Inventors: James L. Payne, Osseo, MI (US); Karen S. Fike, Hudson, MI (US); Joyce A. Bump, Hudson, MI (US); Clifford R. Poll, Adrian, MI (US); Mark E. Aldrich, Hillsdale, MI (US)

(73) Assignee: Rima Manufacturing Company, Hudson, MI (US)

( * ) Notice: Subject to any disclaimer, the term of this patent is extended or adjusted under 35 U.S.C. 154(b) by 7 days.

(21) Appl. No.: 09/727,179

(22) Filed: Nov. 30, 2000

(65) Prior Publication Data

US 2002/0064432 A1 May 30, 2002

(51) Int. Cl.[7] ..... A46B 15/00; A47L 25/00

(52) U.S. Cl. ..... 15/160; 15/88.1; 15/104.03; 29/81.01

(58) Field of Search ..... 15/88.1, 104.001, 15/104.03, 160; 29/81.01

(56) References Cited

U.S. PATENT DOCUMENTS

| | | | | |
|---|---|---|---|---|
| 2,551,875 | A | | 5/1951 | Cotton |
| 2,983,940 | A | | 5/1961 | Beyer-Olsen |
| 3,545,081 | A | | 12/1970 | Butler |
| 4,091,490 | A | * | 5/1978 | Allen |
| 4,365,642 | A | * | 12/1982 | Costa |
| 4,598,440 | A | | 7/1986 | Wilson |
| 4,608,727 | A | | 9/1986 | Schwab |
| 4,701,970 | A | | 10/1987 | Wilson |
| 4,704,823 | A | | 11/1987 | Steinback |
| 4,739,534 | A | | 4/1988 | Wilson |
| 4,924,924 | A | | 5/1990 | Stewart |
| 4,998,428 | A | | 3/1991 | Rechenbach |
| 5,016,311 | A | | 5/1991 | Young et al. |
| 5,083,840 | A | | 1/1992 | Young |
| 5,123,139 | A | | 6/1992 | Leppart et al. |
| 5,175,965 | A | | 1/1993 | Sanborn |
| 5,224,231 | A | | 7/1993 | Nacar |
| 5,233,719 | A | | 8/1993 | Young et al. |
| 5,247,765 | A | | 9/1993 | Quintana |
| 5,295,278 | A | | 3/1994 | Condon et al. |
| 5,321,919 | A | | 6/1994 | Scheider et al. |
| 5,419,015 | A | | 5/1995 | Garcia |
| 5,454,751 | A | | 10/1995 | Wiand |
| 5,503,892 | A | | 4/1996 | Callaway |
| 5,520,022 | A | | 5/1996 | Callaway |
| 5,609,516 | A | | 3/1997 | Courson et al. |
| 5,616,155 | A | | 4/1997 | Kronzer |
| 5,707,707 | A | | 1/1998 | Burnes et al. |
| 5,807,161 | A | | 9/1998 | Manor et al. |
| 5,807,167 | A | | 9/1998 | Walsh |
| 5,903,951 | A | | 5/1999 | Ionta et al. |
| 5,970,559 | A | * | 10/1999 | Christy |
| 5,997,386 | A | | 12/1999 | Dumond, Jr. et al. |
| 6,007,415 | A | | 12/1999 | Van Osenbruggen |
| 6,081,959 | A | | 7/2000 | Umbrell |
| 6,298,514 | B1 | * | 10/2001 | Lazich |

FOREIGN PATENT DOCUMENTS

| | | |
|---|---|---|
| CH | 332759 | * 11/1958 |

* cited by examiner

*Primary Examiner*—Randall E. Chin
(74) *Attorney, Agent, or Firm*—Young & Basile, P.C.

(57) ABSTRACT

A deburring tool for performing non-abrasive deburring of metal and other hard-material parts subject to burring. The deburring tool comprises a portion shaped to engage a specific surface on a workpiece, and surfaced with a deburring material comprising the soft, fuzzy, female loop half of ordinary hook and loop fastener. The female loop half of the hook and loop fastening material is non-abrasive, yet is extremely effective at removing small burrs and shavings from metal parts. In a preferred form, the deburring tool forms a two-sided deburring channel or track through which a part such as a hose connector block having a recessed surface needing deburring can be swiped. Both sides of the channel are surfaced with the female loop half of the hook and loop fastener as the deburring medium.

10 Claims, 3 Drawing Sheets

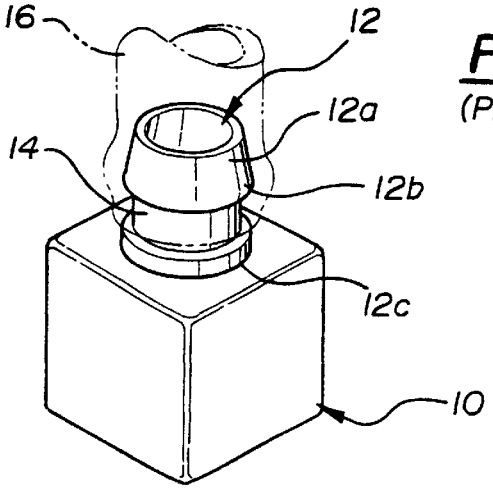
FIG-1
(PRIOR ART)
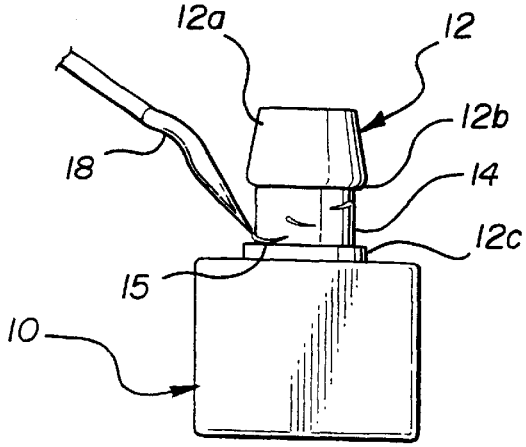
FIG-2
(PRIOR ART)
FIG-3
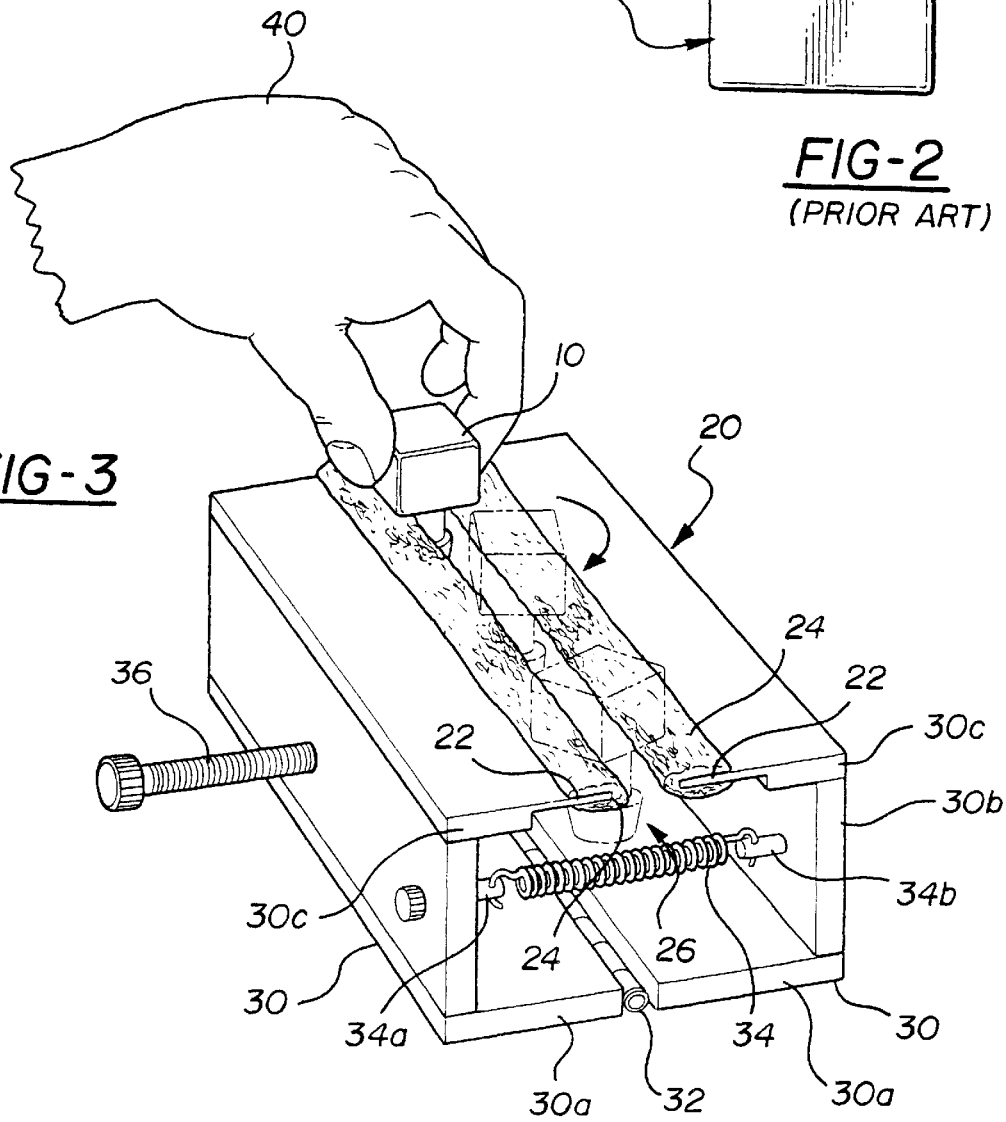

NON-ABRASIVE DEBURRING DEVICE FOR METAL PARTS

FIELD OF THE INVENTION

The present invention is in the field of metal finishing media and devices, and more particularly to media and devices for the deburring of metal surfaces.

BACKGROUND OF THE INVENTION

The manufacture of smoothly-finished metal parts, especially those adapted to be mated with relatively soft materials (for example, metal hose connector blocks of the type used in the automotive industry) often requires final finishing or "deburring" of critical areas. In the hose connector block example, the hose connector barb is typically formed with a recessed O-ring seat or groove which must be thoroughly deburred so as not to damage the important O-ring seal seated under the hose barb. Tiny burrs and metal shavings which remain clinging to the surface of the O-ring seat, which may have been acceptable under earlier standards, are often no longer acceptable under current quality standards and finishing guidelines. In these and other mass production metal finishing operations, it is frequently necessary for each part to be visually inspected and manually deburred using picks and brushes of known type.

While abrasive brushes and pads for the deburring and polishing of metal and hard plastic components are well known, none is particularly suitable for the final light deburring of small metal parts with recessed surfaces, particularly where the abrasive nature of the brushes, pads, etc. would damage critical tolerances achieved on adjacent surfaces in other finishing operations prior to final deburring. The automotive hose connector example given above is typical of metal parts which, although needing final deburring of certain surfaces, cannot be subjected to abrasive materials which would alter critical tolerances on or adjacent the surface being deburred. Prior art deburring and finishing devices using pad, brush, and other abrasive materials are typically designed for finishing large surface areas, employed as relatively wide belts, large disks, one-size-fits-all brush heads and other tools unsuitable for this type of light deburring.

SUMMARY OF THE INVENTION

In its broadest form, the present invention is a tool designed to finish a particularly-shaped surface on a metal part, the tool being surfaced with a layer of deburring material which, surprisingly, is non-abrasive. Even more surprisingly, that deburring material is the soft, fuzzy, "female" loop half of the hook-and-loop material commonly sold under brand names such as VELCRO®, SCOTCHMATE®, SMARTTOUCH®, FASTOUCH®, and others.

The soft, conforming, non-abrasive nature of the loop half of the hook and loop material (hereafter referred to as the "loop deburring material"), and the adhesive-backed format in which it is perhaps most commonly found, allows it to be applied to the surfacing of a variety of relatively small, specially-configured tool surfaces designed to place the loop deburring material in conforming contact with the surface to be deburred. At the same time, in situations where the deburring tool is shaped for a small or recessed surface surrounded by other surfaces whose tolerances and finishes should not be altered, the non-abrasive nature of the loop deburring material will leave those other surfaces unaltered while performing the desired deburring operation on even small, hard-to-reach surfaces.

A common problem with abrasive deburring materials is that too much pressure is applied, resulting in damage to the surface being deburred. A tool surfaced with the non-abrasive loop deburring material tool according to the present invention is incapable of damaging the underlying surface. It simply removes small burrs and shavings which remain clinging to the underlying surface.

Although a deburring tool according to the invention can be configured in almost any shape, a preferred form of the invention has been developed for annular, recessed seats or grooves of the type used as O-ring seats in hose connector blocks. In this preferred form, the invention comprises a rigid tool or support having two edges defining a channel therebetween, the channel having a width approximating the diameter of the annular surface being deburred. Each side of the channel is surfaced with the non-abrasive loop deburring material having a depth and thickness designed to engage the entire surface area of the groove being deburred. The channel is open at least at one end, and preferably at both ends, to define a swipe-through deburring track through which the person performing the finishing operation can simply swipe the part with its annular groove seated in the track. A small amount of workpiece rotation on the way through the track serves to quickly and thoroughly deburr the entire seating surface.

In a further preferred form, the deburring faces on the channel-defining tool are adjustable to accommodate parts having different diameters. In one form the support comprises a pair of hinged halves which can be adjusted to vary the width of the channel which can then be secured in place to define a deburring channel of a width suitable for a particular part.

These and other features and advantages of the invention will become apparent upon a further reading of the specification, in light of the accompanying drawings.

BRIEF DESCRIPTION OF THE DRAWINGS

FIG. 1 is a perspective view of a prior art hose connector block, illustrating the end of a hose connected to the barb in phantom.

FIG. 2 is a side elevational view of the hose connector block of FIG. 1, schematically illustrating the prior art method of manual pick removal of burrs and shavings from the recessed O-ring seat.

FIG. 3 is a perspective view of the invention applied in a preferred tool configuration for deburring recessed annular seats of the type shown in the hose connector block of FIGS. 1 and 2.

DETAILED DESCRIPTION OF THE ILLUSTRATED EMBODIMENTS

Figure 4:
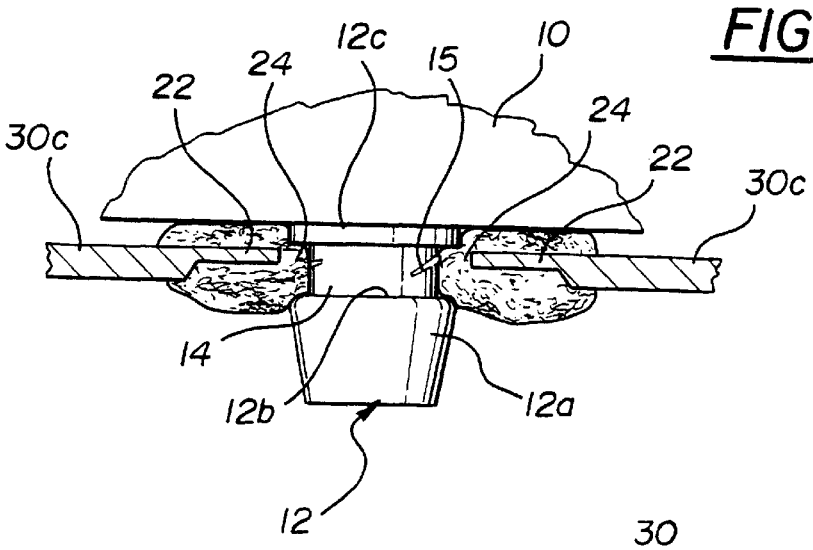
FIG. 4 is a side elevational view, in section, of an end of the deburring channel defined by the tool of FIG. 3.

Referring first to FIGS. 1 and 2, a metal part of the type which the present invention is especially well-suited for deburring is illustrated as an automotive hose connector block 10, machined from metal such as aluminum. Hose connector block 10 is a device which is well known, and commercially available, and blocks of this type are manufactured and sold by the assignee of the present application. It will further be understood that the block illustrated in FIG. 1 is a somewhat schematic and generic representation of many different styles and shapes of connector block.

The tolerances and surface finishes of connector block 10 can be extremely important, particularly in automotive applications in which fluids critical to the functioning of a vehicle are routed through the connector block to and from hoses such as 16 secured to block 10 in sealing fashion over hose barb 12. The typically soft, flexible hose 16 conforms itself to the conical sidewall portion 12*a*, shoulder 12*b*, and cylindrical base 12*c*, which must themselves be smoothly finished to provide a good seal and to avoid abrading the hose. The seal between hose 16 and barb 12 is often enhanced with an O-ring (not shown) of known type seated in an annular O-ring groove or seat 14 between barb shoulder 12*b* and barb base 12*c*. Although in the illustrated embodiment the O-ring 14*a* is shown as enhancing the sealing fit between a hose 16 and the connector block, an O-ring equipped barb such as that shown in FIG. 1 may also be used to make direct plug-in connection to mating, rigid metal or plastic components, wherein the O-ring functions as the primary seal. In either case, the integrity of the O-ring seal must be maintained over the life of the part, and to this purpose it is desirable to provide a burr-free finish on the O-ring seat 14.

Referring to FIG. 2, after the final machining and finishing of connector block 10 and O-ring seat 14, there often remain small shavings or burrs such as those schematically illustrated at 15. Burrs 15 can damage the O-ring as it is installed and can further damage the O-ring over extended periods of use. These tiny shavings and burrs 15, for example on the order of a millimeter to several millimeters and generally having a curled or hooked configuration, should optimally be removed to provide the best possible seating surface for a seal such as an O-ring. Accordingly, FIG. 2 illustrates the preferred prior art method for removing these burrs 15, namely visual inspection and manual removal of the burrs with a delicate pick instrument 18. It will be understood that for runs of parts numbering in the thousands, tens of thousands, or even millions, this visual inspection and deburring is an extremely time-consuming and expensive process for the manufacturer.

Moreover, it is possible to damage the surface of O-ring seat 14 and adjacent surfaces such as shoulder 12*b*, sidewall 12*a*, and base 12*c* on the connector barb if the pick is made from a material harder than that of the connector block and if sufficient care is not exercised by the person removing the burrs. Also, visual inspection and manual deburring leaves significant room for error in the deburring process.

Referring now to FIGS. 3 and 4, a known material has been unexpectedly discovered to be especially well-suited for deburring operations such as that described in reference to FIGS. 1 and 2. This known material is further readily adapted to being conformed to surface specialized deburring tools which provide virtually perfect deburring of all significant burrs and shavings on such metal surfaces. Deburring tools made in accordance with this invention greatly reduce operator time and eliminate the need for visual inspection, and further cannot damage, abrade, or otherwise alter the already-finished and often critically toleranced surfaces adjacent the portion being deburred. As shown in FIG. 3, a tool 20 according to the invention is provided with one or more deburring surfaces 22 surfaced with a deburring material 24 in the form of the soft, fuzzy, "female" loop half of ordinary hook and loop fastener material commonly sold under trademarks such as VELCRO®, SCOTHMATES®, FASTOUCH®, and others. Other terms which have been used by those skilled in the art of hook and loop material to describe this soft, female loop half are "fuzzy", "pile side", and "carpet side". This material is supplied in many different forms, materials, and fastening characteristics, but the type that is best suited for the present invention is the typically woven loop variety made from nylon, polyester, and similar filament materials. The material also comes in open and closed loop varieties. Currently the preferred form which has been used is the female, fuzzy half of the VELCRO® brand self-adhesive hook and loop fastener (No. 90082, sold in a three-quarter inch width white tape format in 15-foot strips contained in a dispenser box) available from VELCRO, USA, INC. All reasonable equivalents of this material are believed to be suitable for use with the present invention, although this brand and type are currently preferred.

The deburring loop material 24 is non-abrasive, unlike the specially formed or treated fibers of many abrasive pads and brushes. Its loop nature grabs onto the small shavings and burrs 15 such as those illustrated in FIG. 2, similar to the manner in which the loop material engages the hook portion of hook and loop material for a fastening procedure. Unlike the fastening scenario, however, the deburring loop material 24 pulls the burrs and shavings free from the surface being finished as it is moved thereover.

The tool 20 illustrated in FIGS. 3 and 4 is specifically designed for the deburring of recessed, preferably annular, surfaces such as the recessed O-ring seat 14 of the type found in connector block 10. Tool 20, which except for the deburring loop material 24 is largely machined from a rigid material such as aluminum, steel, or hard plastic, defines a deburring channel 26 between its deburring surfaces 22, channel 26 having a width approximating the diameter of annular O-ring seat 14. With deburring loop material 24 secured to deburring surfaces 22 as illustrated, for example by applying the adhesive backing commonly found on commercially sold strips of the loop material 24 to the top and bottom edges of the deburring surfaces 22, the deburring loop material 24 is brought into conforming, deburring contact with O-ring seat 14 as best shown in FIG. 4.

It is difficult, if not impossible, to surface a deburring tool with a conforming, three-dimensional material and confine the contact of the material only to the surface being deburred. Instead, adjacent surfaces such as the top of connector block 10, barb base 12*c*, barb shoulder 12*b*, and even barb sidewall 12*a* are inevitably contacted by the deburring material. However, because deburring loop material 24 is non-abrasive with respect to the hard material of the part being finished, previously-established surface finishes and tolerances of these adjacent portions are unaffected by the deburring operation. Nor is the underlying surface dimension of O-ring seat 14 affected; only the burrs 15 are removed, without any measurable abrasion, reduction or surface alteration of O-ring seat 14. This is highly desirable for a final finishing or deburring step in which the next procedure will be installation of the part or the application of an O-ring or hose or other soft connector which requires a burr-free surface.

Tool 20 defining the deburring channel 26 is illustrated in a preferred adjustable form, comprising two identical halves 30 with bottom walls 30*a*, sidewall 30*b*, and top walls 30*c* terminating in the deburring surfaces 22 surfaced with the deburring loop material 24. Halves 30 are hinged at 32 to adjust the width of channel 26, and when the desired width is achieved the halves are secured in place with an adjustment screw 36 extending through one sidewall 30*b* and abutting the side surface of the opposite sidewall 30*b* to counteract the force of one or more springs 34 anchored to each sidewall at 34*a*, 34*b* and tending to draw the halves together. The adaptability of tool 20 allows a single tool to be adapted to deburr similar parts of different size or gauge.

In the illustrated embodiment of FIG. 3, it is preferred to place a spring 34 near each end of tool 20, and to place them symmetrically for an even spring tension along the length of channel 26. Asymmetric spring tension arrangements are also possible, depending on the part.

The open-ended channel is also believed to be easier than a closed-ended channel to adapt the tool to the automated swipe-through of parts, for example by a robotic arm. For this purpose it may be desirable to chamfer or otherwise modify the "entrance" end of the channel to help smoothly guide the part into the channel.

It will be understood by those skilled in the art that although the preferred adjustment mechanism for tool 20 is illustrated as a pivoting or hinged connection, other known types of adjustable connection can be made between the halves of tool 20, for example including but not limited to sliding track arrangements or pin arrangements which allow for the linear transverse adjustment of the tool portions which define the channel and its width.

It will be understood that adjustment screw 36 establishes a minimum rather than a maximum width, and in the spring-tensioned embodiment the minimum width of channel 26 can be established to be slightly less than the diameter of O-ring seat 14, such that insertion of a part's O-ring seat into channel 26 will require a slight amount of force tending to spread halves 30 just far enough apart to apply the deburring loop material 24 to the O-ring seat under spring tension to ensure uniform pressure and complete coverage.

FIG. 3 illustrates the simple swipe-through method of deburring a part such as connector block 10 by starting it in one end of channel 26, moving it along channel 26 with an occasional rotational movement to make sure that the entire surface of O-ring seat 14 has been swept over deburring loop material 24, and finally swiping the part through and out of channel 26 at the opposite end. It will of course be understood that the channel need not be open-ended as shown, although it is preferred to be able to swipe the part all the way through in one direction rather than having to swipe the part in, rotate it, and swipe it back out in the reverse direction.

Figure 5:
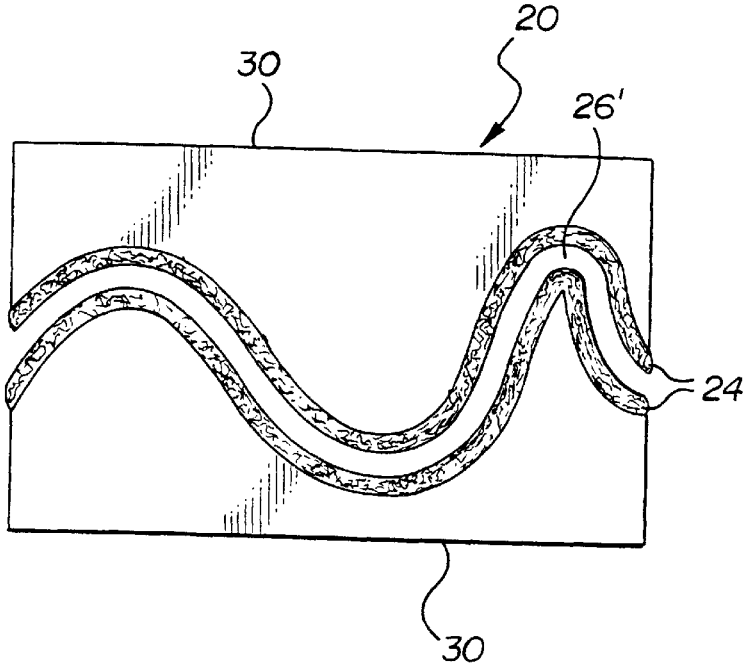
FIG. 5 is a plan view of an alternate deburring channel capable of being formed in a tool of the type shown in FIG. 3.

Referring next to FIG. 5, an alternate deburring channel configuration 126 is illustrated for tool 20, in which the track is serpentine rather than linear. This is simply to show that the swipe-through deburring channel embodiment of the invention can take different forms, depending on the deburring operation, the nature of the part, the desired number of passes or swipes, and other job-specific considerations which will be apparent to those skilled in the art.

Figure 6:
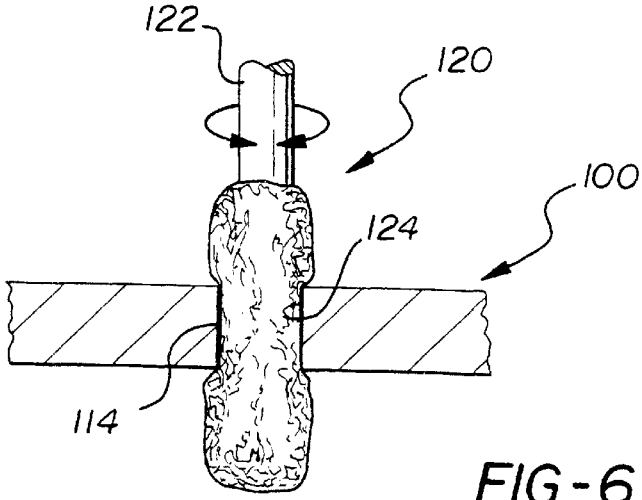
FIG. 6 illustrates an alternate application of the invention, in which the tool and its loop deburring material have been formed to deburr a hole.

Referring next to FIG. 6, a deburring tool 120 is illustrated for deburring a hole or bore 114 and a part such as 100. Deburring tool 120 comprises a rotating shaft 122 with deburring loop material 124 formed roughly as a cylinder on the end of shaft 122. The diameter of shaft 122 is chosen such that an appropriate thickness of deburring loop material 124 with which it is surfaced is brought into conforming contact at the appropriate pressure with a bore 114 of a known diameter. In this manner, tool 120 is designed specifically for the deburring of a specific part. Again, deburring loop material 124 may be secured to the end of shaft 120 with its own, commercially-supplied adhesive backing. It will be understood, however, that other known methods of attaching hook and loop material to an object can be used.

Figure 7:
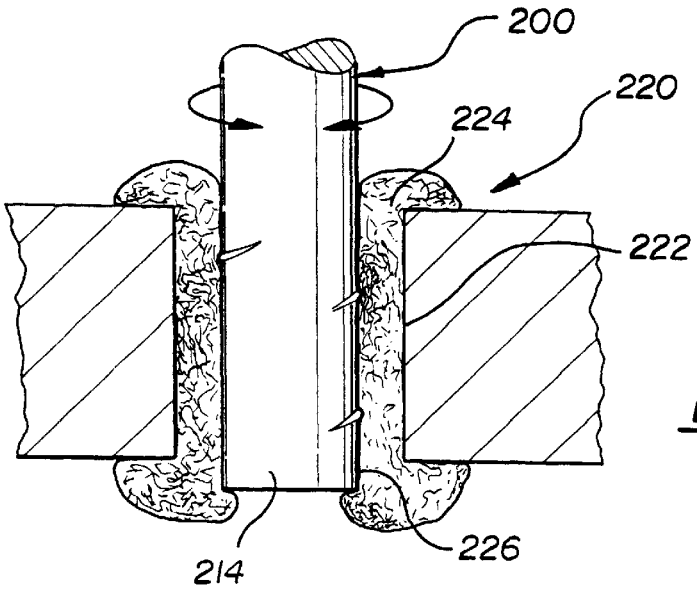
FIG. 7 illustrates an alternate application of the invention in which the tool and loop deburring material of the invention have been configured to deburr a shaft, which is rotated in the tool.

Referring next to FIG. 7, another possible embodiment of the invention is shown as a tool 220 designed specifically for the deburring of a portion of a workpiece 200, such as a cylindrical shaft 214 of a given diameter. Tool 220 establishes a circular deburring surface 222 covered with deburring loop material 224 to define a deburring bore 226 sized to receive, properly conform to, and thoroughly deburr a workpiece such as cylindrical shaft 214 of a given diameter. Again, deburring loop material 224 can be secured to a circular deburring edge 222 in any known fashion, although the readily-available adhesive backing is preferred.

Figure 8:
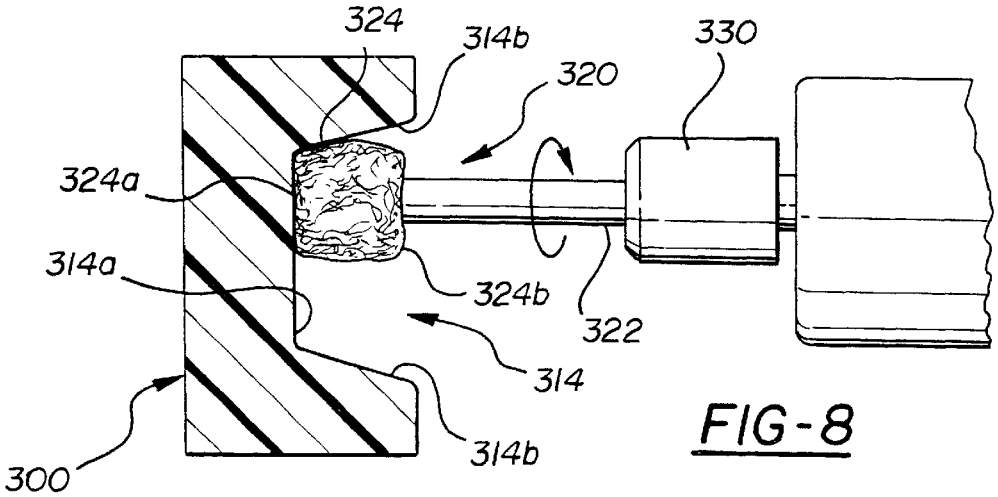
FIG. 8 illustrates an alternate application of the invention in which a deburring tool according to the invention has been configured to be applied in rotating fashion to a multi-sided, recessed surface.

Referring next to FIG. 8, yet another embodiment of a tool incorporating the present invention is illustrated at 320, comprising a rotary shaft 322, with a mass of deburring loop material 324 secured to one end, sized and shaped (in the illustrated embodiment, a somewhat squat, drum-like configuration) to conformingly engage a multi-sided recessed surface 314 having both bottom and side edges 314*a*, 314*b* for a deburring operation. In the illustrated embodiment, shaft 322 is rotated by a common drill 330. Furthermore, deburring loop material 324 presents deburring material both on the sides thereof and at the "bottom" end furthest from drill 330, so as to be able to engage both the bottom and side surfaces of a recessed surface such as 314.

Figure 9:
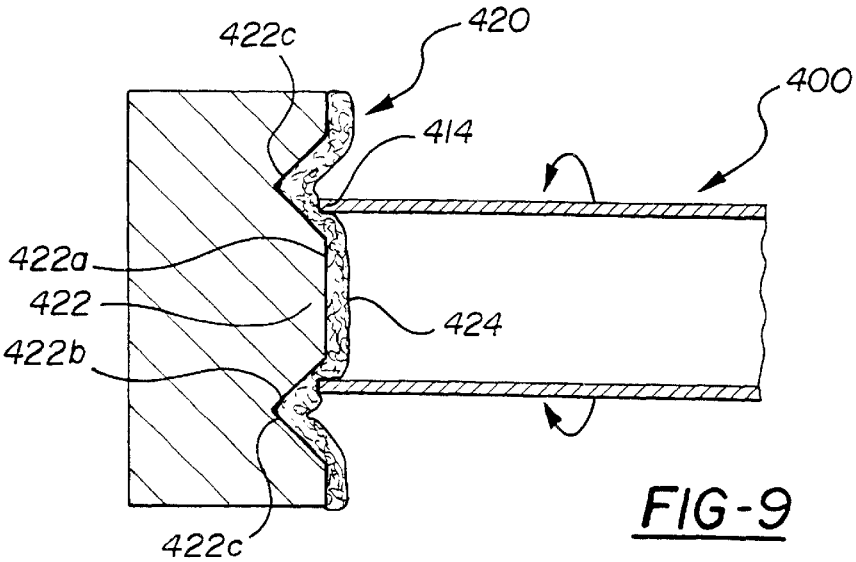
FIG. 9 illustrates an alternate application of the invention in which a deburring tool according to the invention has been configured to deburr the end and inside edge of a hollow tube or pipe.

Referring finally to FIG. 9, another embodiment of the invention is shown as tool 420 comprising a metal base 422 establishing an angled, truncated, cone-shaped deburring surface 422*a* covered with the deburring loop material 424 so as to conformingly engage and deburr the end and inside edges of a tubular pipe opening on a pipe-like workpiece 414. Although tool 420 may be fashioned to deburr only a single size pipe 414, in the illustrated embodiment tool 420 with its long conical edge 422*a* and its V-shaped surrounding channel 422*c* is capable of deburring the ends of pipes of different diameters, as will be apparent to those skilled in the art.

The foregoing illustrated embodiments of the invention are but a few of the many possible tool configurations in which the invention can be embodied. It will therefore be apparent to those skilled in the art that tools for deburring virtually any shape, surface, or recess can be readily fashioned according to the present invention. It will therefore be understood that we do not intend the invention to be limited to embodiments disclosed, as many modifications, variations and equivalents will be apparent to those skilled in the art now that we have disclosed the invention.

Accordingly, we claim:

1. A deburring tool for light deburring of metal and hard plastic parts, comprising:

a deburring portion surface with a non-abrasive, soft looped half of a hook and loop fastening material having two opposed deburring faces surfaced with the deburring material and opposing one another to define a deburring channel through which a part is swiped.

2. The deburring tool of claim 1, wherein the channel is open-ended.

3. The deburring tool of claim 1, wherein the deburring surfaces are positioned on separate portions of the deburring tool, said separate portions being moveable relative to each other to selectively adjust the width of the deburring channel.

4. The deburring tool of claim 1, wherein the opposed deburring faces are adjustably connected to one another such that a width of the deburring channel can be adjusted.

5. The deburring tool of claim 4, wherein the deburring tool includes a spring member operatively connected to each of the opposed deburring faces such that the opposed deburring faces are under spring tension tending to draw them toward one another.

6. The deburring tool of claim 5, wherein each of the opposed deburring faces is mounted on one of two tool portions, the tool portions being pivotally connected and drawn toward one another by the spring member, and further wherein at least one of the tool portions is provided with an adjustable stop member adapted to engage the other of the tool portions at different spacings of the deburring channel to limit the movement of the deburring faces toward one another and thereby define a minimum width for the deburring channel which can be expanded under spring tension by forcing the deburring faces apart.

7. The deburring tool of claim 1, wherein the separate portions of the deburring tool are biased towards each other, and wherein further the deburring tool includes means for maintaining said separate portions of the deburring tool at a desired distance relative to each other.

8. The deburring tool of claim 1, wherein the width of the deburring channel is selectively adjustable.

9. A deburring tool, comprising:

First and second halves being halves adapted to be moveable relative to each other, each said half including a deburring face surfaced with a non-abrasive, soft, loop half of a hook and loop fastening material, said deburring surfaces opposing one another to define a deburring channel through which a part is swiped, said halves being biased towards each other, and means for maintaining said first and second halves of the deburring tool at a desired distance relative to each other to thereby selectively adjust the width of the deburring channel.

10. The deburring tool of claim 9, wherein said first and second halves are hingedly connected, and wherein further said deburring tool comprises at least one spring connecting said first and second halves to bias said halves towards a predetermined width of said deburring channel, and an adjustment screw having a principal length that is selectively adjustable between said first and second halves to maintain said first and second halves at a desired distance relative to each other.

* * * * *

UNITED STATES PATENT AND TRADEMARK OFFICE

CERTIFICATE OF CORRECTION

PATENT NO. : 6,539,574 B2
DATED : April 1, 2003
INVENTOR(S) : Payne et al.

It is certified that error appears in the above-identified patent and that said Letters Patent is hereby corrected as shown below:

Column 4,
Line 15, delete "SCOTHMATES®" and insert --SCOTCHMATES® --.

Signed and Sealed this

Seventeenth Day of June, 2003

JAMES E. ROGAN
*Director of the United States Patent and Trademark Office*